United States Patent [19]

McElroy

[11] Patent Number: 4,854,853

[45] Date of Patent: Aug. 8, 1989

[54] WASTE COMBUSTION SYSTEM

[75] Inventor: James G. McElroy, Houston, Tex.

[73] Assignee: Kirox, Inc., Houston, Tex.

[21] Appl. No.: 139,684

[22] Filed: Dec. 30, 1987

Related U.S. Application Data

[63] Continuation-in-part of Ser. No. 937,948, Dec. 4, 1986, Pat. No. 4,764,105.

[51] Int. Cl.[4] ..... F23M 9/00

[52] U.S. Cl. ..... 431/115; 431/9; 431/158; 431/185; 110/238

[58] Field of Search ..... 431/2, 5, 8, 9, 115, 431/116, 171, 172, 158, 177, 252, 258, 353; 110/238; 239/419.3, 427.5, 433, 434.5

[56] References Cited

U.S. PATENT DOCUMENTS

| | | | |
|---|---|---|---|
| 3,485,566 | 12/1969 | Schoppe | 431/158 |
| 3,644,076 | 2/1972 | Bagge | 431/284 |
| 3,663,153 | 5/1872 | Bagge et al. | 431/158 |
| 3,749,548 | 7/1973 | Zink et al. | 431/115 |
| 3,838,975 | 10/1974 | Tabak | 431/5 |
| 3,880,571 | 4/1975 | Koppang et al. | 431/8 |
| 4,120,639 | 10/1978 | Thekdi et al. | 431/158 |
| 4,309,165 | 1/1982 | McElroy | 431/181 |
| 4,410,308 | 10/1983 | McElroy | 432/149 |
| 4,556,386 | 12/1985 | McElroy | 432/149 |

FOREIGN PATENT DOCUMENTS

| | | | |
|---|---|---|---|
| 700092 | 12/1964 | Canada | 431/9 |
| 952814 | 8/1974 | Canada | 431/9 |
| 1017877 | 5/1983 | U.S.S.R. | 431/9 |

*Primary Examiner*—Noah P. Kamen

*Attorney, Agent, or Firm*—David A. Rose

[57] ABSTRACT

A combustion system includes waste, fuel, and oxidizer conduits which exit into a combustion chamber. The combustion chamber is lined with refractory within a metal housing and includes a shoulder. A venturi extends between the combustion chamber and an oxidizer manifold mounted on one end of the combustion chamber. The waste conduit communicates with a nozzle in the venturi for atomizing the waste in the combustion chamber. The fuel conduit communicates with ports in the venturi whereby as the oxidizer passes through apertures in the venturi, the fuel is introduced into the oxidizer stream. The mixture of oxidizer and fuel is deflected toward the wall of the combustion chamber where the mixture becomes entrained with the atomized waste from the nozzle. The waste mixes with the mixture of oxidizer and fuel by turbulent flow and is redirected by the shoulder towards the nozzle.

18 Claims, 4 Drawing Sheets

FIG. 2
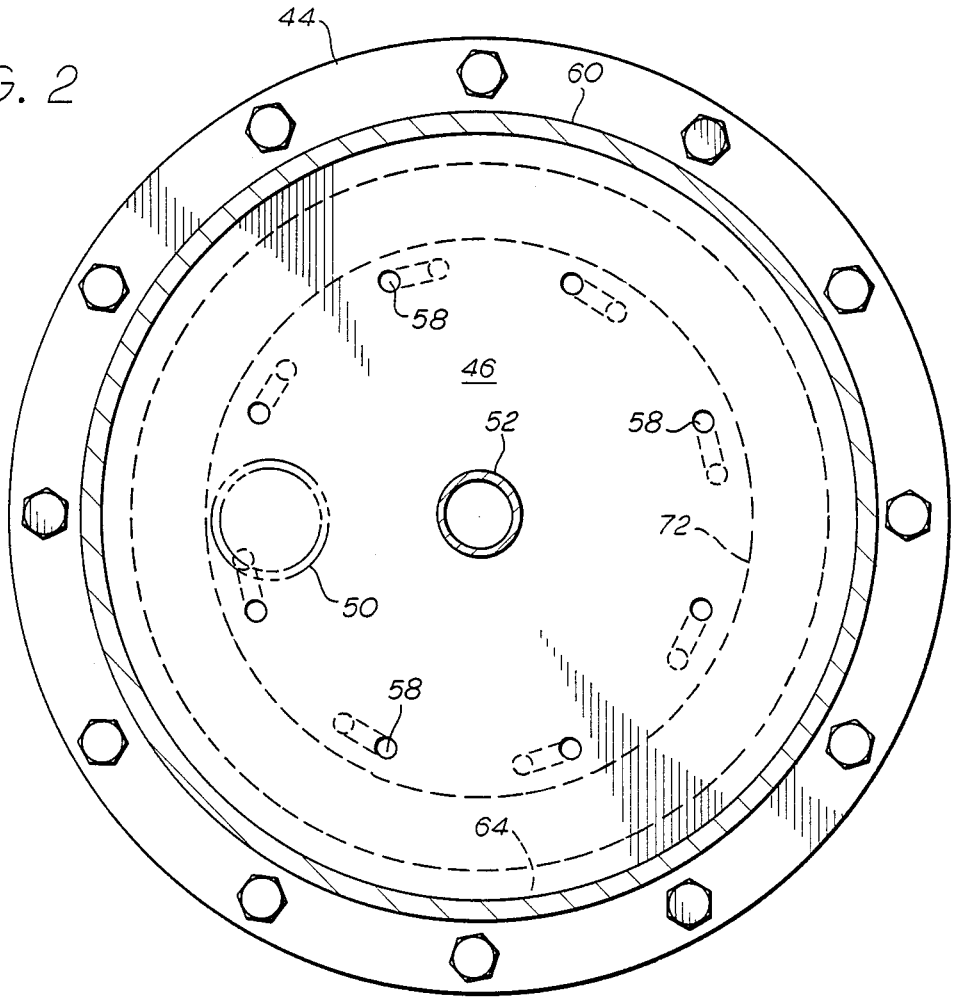
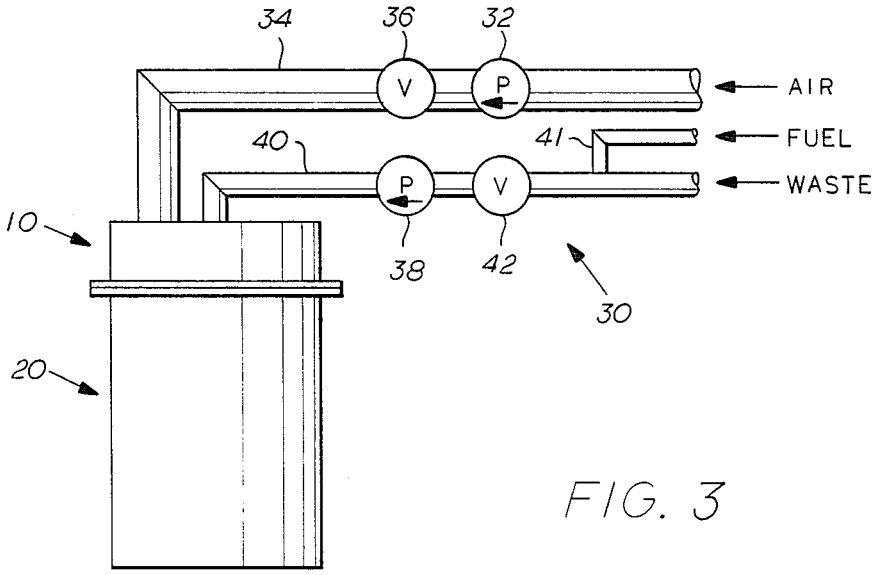
FIG. 3

WASTE COMBUSTION SYSTEM

RELATED APPLICATION

This application is a continuation-in part application of my application Serial No. 937,948, filed Dec. 4, 1986 now U.S. Pat. No. 4,764,105.

TECHNICAL FIELD

This invention pertains to combustion systems and more particularly to systems suitable for the burning of waste.

BACKGROUND ART

The industrial world is facing a tremendous problem in the disposal of the waste that is being generated by industry. The Environmental Protection Agency has issued regulations on the disposal of such waste, and industry is struggling with developing an economical method for the disposal of waste which also meets the requirements of such regulations.

Incineration has been used in the past as a means for the disposal of waste. See the article "Circulating Bed Incineration of Hazardous Wastes" by Dickinson, Holder, and Young published in CEP, Mar. 1985.Prior art incineration is a very costly process requiring highly sophisticated incineration equipment. Oftentimes, such incineration processes result in the formation of other undesirable contaminants which cannot be emitted to the environment.

Hydrocarbon waste is one of the wastes for which there is a disposal problem. Examples of hydrocarbon wastes include alkaryls, dioxin, fluorinated hydrocarbons, toluene, polychlorinated biphenyls (PCBs), mineral oil contaminated with PCBs, chlorinated phenols, various pesticides and herbicides, contaminated soils, absorbents such as carbon black, and other wastes having hydrocarbons. Hydrocarbon waste is primarily gaseous and/or liquid. However, these gaseous and/or liquid hydrocarbon wastes may also include entrained solids. Attempts have been made to burn such hydrocarbon wastes. However, the flue gases emitted from such prior art waste furnaces must meet the requirements of the Environmental Protection Agency. The EPA requires that the resulting airstream of flue gases be practically 100% free of contaminants. Prior art systems have had difficulty achieving a complete combustion of hydrocarbon waste so as to meet these EPA requirements. See the article entitled "Hazardous Waste Management New Rules Are Changing the Game" by Donald R. Cannon published in *Chemical Week*, Aug. 20, 1986.

Prior art waste combustion systems generally operate under a negative pressure (below atmospheric) where the pressure in the combustion chamber is, for example, a fraction of an inch of water column of vacuum. The prior art combustion chamber is not pressurized to insure there are no leaks of the waste from the combustion chamber into the atmosphere. The prior art waste combustion systems, therefore, require a combustion chamber which is excessive in size. Further, the particles of waste float in the combustion chamber as they are burned. This procedure requires that the combustion process be operated over a longer period of time to insure complete combustion of the waste.

One such prior art system is operated by the Rollins Company where liquid waste and air are mixed for initial combustion in a lodby for emission into an afterburner chamber for more complete combustion. A rotary kiln is used for the combustion of solid waste which is also emitted into the afterburner chamber. Air is introduced into the afterburner chamber to move and rotate the waste for more complete combustion. A vacuum is placed on the afterburner chamber by an air blower to move the combustion products from the afterburner to a water scrub. After the water scrub, the effluent passes to a bag house. This prior art system is large and very expensive. The afterburner alone could be of the size 40 feet by 60 feet and 10 feet high.

U.S. Pat. No. 4,120,639 to Thekdi, et al discloses a high momentum industrial gas burner designed to create a high velocity. The various chambers of the burner are designed so that the fluid pressure within the burner is less than atmospheric pressure. An air and fuel housing is mounted to a block of combustion chambers. The gas fuel flows through a nozzle into a first chamber, and air from an air chamber flows through an annular orifice into he first chamber to be mixed with the fuel and ignited. The combustion products enter a larger diameter chamber to recirculate the gases and the flame. The combustion products from this chamber enter a flame tunnel having a smaller diameter. The block design includes a chamber where the combustion products flow from a larger diameter chamber into a narrower chamber.

U.S. Pat. No. 3,485,566 to Schoppe discloses a combustion gas chamber comprising a burner head mounted on a conical-shaped flame tube. The flame tube widens conically in the direction of the main flow of the throughput. The fuel can be fed in at the intake end where the combustion air is also fed in via an air swirling device with predominately radially directed guide vanes and with an accelerating nozzle for the flame gases connected with the outlet end of the flame tube.

U.S. Pat. No. 3,663,153 to Bagge and Kear discloses a combustion device for gaseous fuel having a coaxial burner opening into a combustion chamber. The flame chamber has a smaller diameter than the combustion chamber, and the combustion chamber has a mixing throat which widens and then narrows.

Also of interest are U.S. Pat. Nos. 4,309,165; 4,410,308 and 4,556,386 to McElroy which disclose an air/fuel control system and preheated combustion air. The combustion air is pressurized to create flue gas velocities sufficient to cause a back pressure within the combustion chamber. U.S. Pat. No. 3,880,571 to Koppang, et al discloses a burner assembly for providing reduced emission for air pollutants. U.S. Pat. No. 3,644,076 to Bagge discloses a liquid fuel burner.

The present invention provides a multi-stage combustion process which insures complete waste combustion. Further, the system of the present invention pressurizes the waste and oxygen supply to shorten the period of time for achieving waste combustion to thereby more efficiently and economically dispose of such waste. The present invention also permits a smaller combustion chamber. In addition the multi-stage combustion system may include a heat exchanger for recovery of heat formed in the combustion of the waste. Thus, the present invention overcomes defects in the prior art.

SUMMARY OF THE INVENTION

In accordance with the teachings of the present invention, a burner assembly of the forced draft type includes a set of waste and oxidizer conduits which exit into the combustion zone of a combustion chamber. The oxidizer/waste conduits communicate with a source of pressurized gaseous oxidizer such as air, a source of the waste to be disposed, and apparatus for regulating the pressurization of the waste and air. The combustion chamber includes a primary chamber and a secondary chamber formed by a lining of refractory within a metal housing. The burner assembly is at one end of the primary combustion chamber and disposed on the other end is the secondary chamber which forms a shoulder facing the burner assembly. A nozzle is disposed at the outlet of the waste conduit to flare the spray of the fluid waste into the primary combustion chamber. The waste is subjected to forces which assist in the atomization of liquid waste. The gaseous oxidizer is introduced into the primary combustion chamber to mix with the waste at the periphery thereof. The nozzle end of the waste conduit causes the waste to become entrained and mixed with the combustion air adjacent the inner lateral walls of the primary combustion chamber and above the shoulder. The air or any gaseous oxidizer exiting from conduits is intercepted by the waste exiting from the waste conduit. Mixing occurs as the result of an exchange of momentum between the reactant streams. The waste mixes with the air by turbulent flow. The pressure of the air and waste may create a velocity sufficient to cause a back pressure within the primary combustion chamber. By controlling the pressure of the reactant streams, properly sizing the waste and air conduits, and selectively sizing and positioning the conduits, the combustion of the mixed stream is maximized. As the waste and combustion air mix within the primary combustion chamber under pressure, the waste and air are mixed for ignition and initial combustion.

The resulting product produced by the initial combustion impinges upon an inner radial annular shoulder formed between the primary and secondary combustion chambers, thereby causing turbulence and turbulent flow before leaving the primary combustion chamber. The resulting product of the first combustion may then undergo a second combustion before exiting into the secondary combustion chamber. The reduced diameter or shoulder between the primary and secondary combustion chamber causes an increase in the concentration of the resulting products of the combustion in the primary combustion chamber and the remaining air. This increased concentration then undergoes a further or third stage combustion which insures the complete combustion of all waste.

Accordingly, it is an object of the present invention to provide a staged combustion chamber in which there is improved mixing of the waste and resulting combustion products in a plurality of mixing zones within the combustion chamber.

It is also an object of the present invention to provide a combustion assembly which may be operated under pressure in the mixing zone of the combustion chamber.

It is a further object of the present invention to provide a combustion system which controls the reaction kinetics of the combustion process.

It is yet another object of the present invention to provide a combustion system in which there is a reduced emission of gaseous and particulate air pollution.

It is still a further object of the present invention to recover the heat from the combustion system.

These and other advantages and objectives of the present invention will become apparent from the following description.

BRIEF DESCRIPTION OF THE DRAWINGS

For a detailed description of embodiments of the present invention, reference will now be made to the accompanying drawings wherein:

FIG. 2 is a top view of that embodiment shown in FIG. 1;

FIG. 3 is a schematic of the air/waste supply system of the embodiment shown in FIG. 1;

DESCRIPTION OF THE PREFERRED EMBODIMENT

Figure 1:
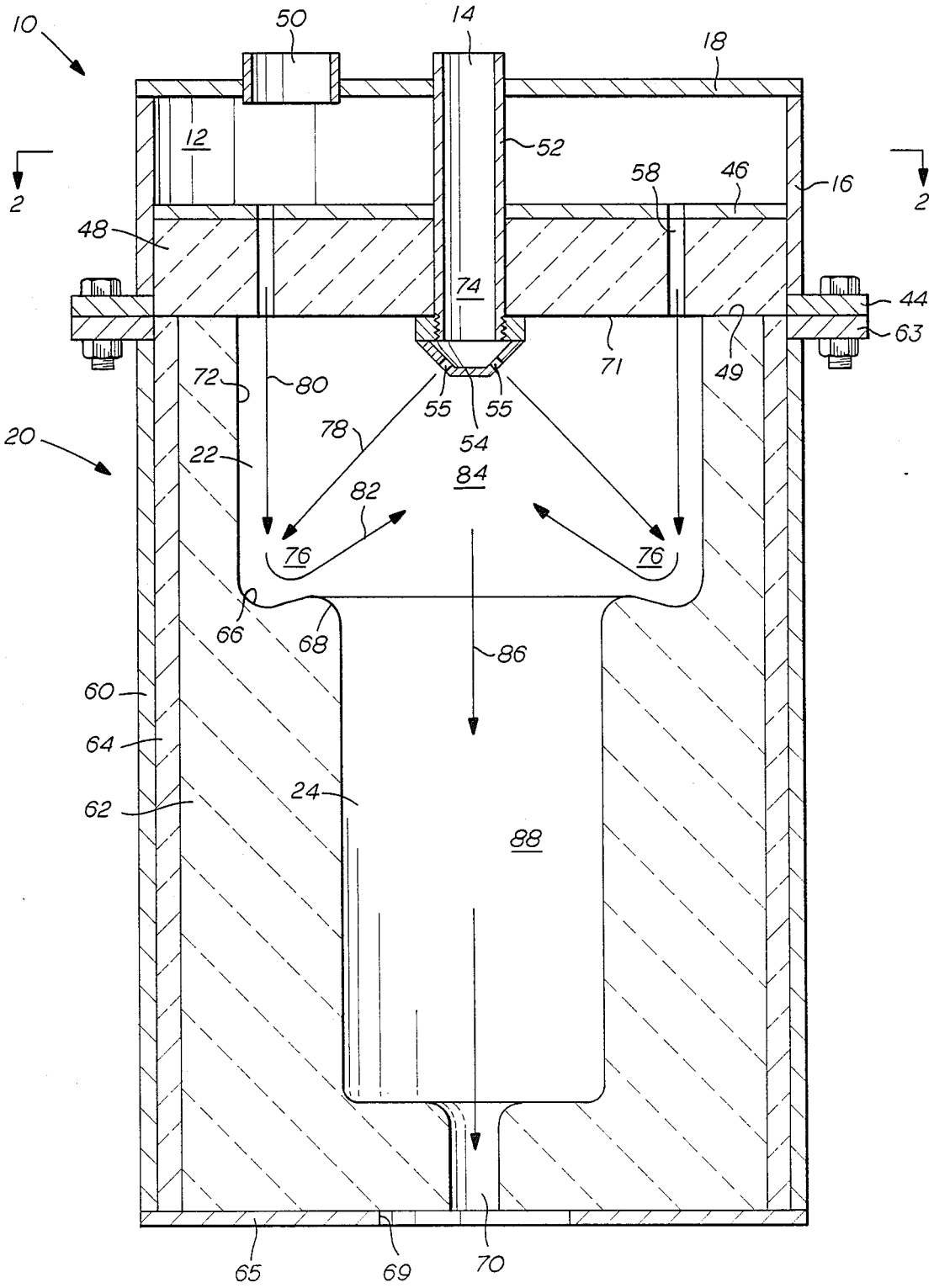
FIG. 1 is a sectional view of one embodiment of the waste combustion system according to the invention.

Referring initially to FIG. 1, the waste combustion system of the present invention comprises a burner assembly 10, a combustion assembly 20, and an air/waste supply system 30. The burner assembly 10 includes an air manifold 12 and a waste manifold 14 for receiving from the air/waste supply system 30 the waste to be disposed and an oxidizer such as air or other gaseous oxidizer. The waste may be any hydrocarbon waste that is in fluid form, i.e. a gas and/or liquid, with or without entrained solids. The waste combustion system of this embodiment is particularly designed for liquid hydrocarbon waste with entrained solids of a size 200 mesh or less. The combustion system 20 of the present invention includes a primary combustion chamber 22 and a secondary combustion chamber 24 for the mixing of the waste and oxidizer and ignition of the waste/oxidizer mixture. The combustion system includes a positive displacement air supplier 32, such as an air compressor, providing the air manifold 12 with combustion air pressurized between 50 and 500 psi and a waste supply (not shown) flowing liquid waste into the waste manifold 14. Although an impellor driven air supply is less expense and could be used, such an air supply is limited in the amount it can pressurize the air. The air and waste, under pressure of between 50 and 500 psi, flows and sprays into the primary combustion chamber 22 for mixing and ignition.

Referring now to FIG. 3, the air/waste supply system 30 includes an oxidizer reservoir (not shown), such as air taken directly from the atmosphere, and a waste supply reservoir (not shown) which may include a storage tank or a generator of waste. The air is introduced into the air manifold 12 by an air compressor or air compressor 32 through an air conduit 34. An air valve 36 is disposed in conduit 34 for the regulation of the air supply. Similarly, the liquid waste from the waste reservoir is introduced into the waste manifold 14 by a 50–500 psi pump 38 and a waste conduit 40. A valve 42 is provided for the regulation of the flow of the liquid waste through supply conduit 40. A fuel line 41 is connected to waste supply conduit 40 to deliver fuel, such as natural gas, No. 2 diesel, propane or butane for example, for initial ignition. As temperatures in the combustion system 20 reach approximately 2400° F., the fuel supply is slowly decreased by a valve in line 41 (not shown) and waste slowly increased by a value (not shown) in line 40 before inlet of line 41 until the combustion is self-supporting. It is preferred that the waste pressure and oxidizer pressure be comparable to achieve uniform fire and avoid any control problem with the oxidizer/waste regulation for the system.

Referring again to FIG. 1, the burner assembly 10 has tubular sides 16 enclosed by a cover plate 18 and by refractory 48 at its other end. Although the burner assembly is shown as being tubular, it can be easily appreciated that it may have various configurations. The air manifold 12 is formed between the cover plate 18 and a divider plate 46. The divider plate 46 abutts the upstream end of refractory 48. The air manifold 12 includes an inlet 50 for connection to the air supply conduit 34 as is schematically shown in FIG. 3. Air inlet 50 is located in the cover plate 18 but may be preferably located in one side of the air manifold 12. The mounting flange 44 and cover plate 18 are welded to the ends of the tubular side portions 16 to form the burner assembly 10.

hhe waste manifold 14 includes a tubular waste conduit 52 extending through the burner assembly 10 for communication with the combustion assembly 20. A nozzle 54, such as are manufactured by Delavan, is provided at the terminal end of waste manifold 14. The inlet end of waste manifold conduit 52 communicates with waste supply conduit 40 shown in FIG. 3 for the supply of liquid waste to manifold 14. A solids filter, not shown, may be provided at nozzle 54 to filter out any undesirable solids in the waste stream.

The air and waste manifolds are preferably made of stainless steel but may be made of carbon steel. The waste and air delivery conduits 34, 40 are normally made of carbon steel.

The combustion air is preheated by convection and conduction from the heat generated in the combustion assembly 20. Preheating the combustion air using the divider plate as a heat transfer agent, substantially increases the efficiency of the burner assembly 10. The air manifold 12 also is sized according to the amount of preheat desired for the combustion air.

The waste manifold 14 and air manifold 12 are air tight to prevent the premature mixture of the combustion air with the waste prior to entrainment within combustion assembly 20. By preventing any premature mixing of the waste with the air, there can be no explosion, backfire, or burn back since there is no oxygen for the waste to burn.

The preheated combustion air in air manifold 12 is supplied to the combustion assembly 20 by a plurality of air orifices or conduits 58 extending through divider plate 46 and refractory 48 and into the upstream terminal end of primary combustion chamber 22. Air inlet conduits or jets 58 are azimuthally spaced around the center axis of the burner assembly 10 and communicate with the upstream end of primary combustion chamber 22 around the inner periphery of the chamber walls 72. Although there may be any number of air conduits, there are preferably eight. The air conduits 58 are sized to provide ample air flow for mixing with the waste stream. The internal diameters of the air supply conduits 58 are machined in size to deliver a calculated amount of air for providing a given number of BTUs during the combustion process. The sizing of air orifices for combustion air is well-known to those skilled in the art. These orifices or conduits 58 also are sized in relation to the exit 70 for the flue gas located at the downstream end of secondary combustion chamber 24, hereinafter described in more detail.

The air compressor 32 may pressurize the combustion air anywhere from 1 psi to approximately 500 psi. The BTUs produced by the combustion can be increased by increasing the pressure. Since the velocity of the air flow through the air conduits 58 is directly proportional to the air pressure in the air manifold 12, it is only necessary to control the air pressure to adjust the air velocity and pressure in the combustion assembly 20.

It should be understood that the air/waste supply system 30 will provide the air and waste for multiple burner systems, and it is not required or desirable to have an individual control system for each burner.

The combustion assembly 20 includes an outer metal jacket or shell 60 with a lining of refractory 62 which is molded to form primary combustion chamber 22 and a downstream secondary combustion chamber 24. A fiber insulation 64 may be provided between the metal shell 60 and refractory lining 62. A flange 63 is welded to the upper end of outer shell 60 for the mounting of burner assembly 10 by bolting mounting flange 44 to flange 63. The refractory 62 engaging refractory 48 is sealed at 49 with refractory 48 by an appropriate sealant. A closure plate 65 is affixed to the downstream terminal end of shell 60.

The primary combustion chamber 22 is circular in cross-section and co-axial with waste conduit 52. The secondary combustion chamber 24 is located downstream of the primary combustion chamber 22 and is co-axial therewith. Secondary combustion chamber 24 is circular in cross-section with a diameter that is smaller than that of primary combustion chamber 22. An annular shoulder 66 is formed by the change in diameters between the primary and secondary combustion chambers. An annular raised portion on shoulder 66 forms an inner radial annular ridge 68.

A flue gas exhaust port 70 is provided at the downstream end of secondary combustion chamber 24 for the venting of the flue gases resulting from the combustion of the waste. Port 70 extends through refractory lining 62 and an enlarged diameter aperture 69 in closure plate 65. Port 70 is co-axial with the primary and secondary combustion chambers. The cross-sectional area of the flue gas port 70 must be approximately eight times larger than the cross-sectional area of the air conduits 58 due to the increase of flue gas volume as the flue gas passes through combustion assembly 20. It is necessary that the air conduits 58 be large enough to permit the free flow of flue gas out of the exit port 70 or otherwise the velocity is reduced at port 70. Although the area of the air conduits 58 must have some minimum size to assure the exiting of the flue gas, the flow of the waste may be regulated by the air/waste valves 32, 38 to prevent the sizing of the waste conduit 52 from becoming critical.

The combustion assembly 20 also includes an ignition system and flame scanner (not shown) to ignite the air/waste mixture. The flame projects away from the combustion side of the mounting plate. The flame propagation will depend upon the waste and air pressures which are maintained in the air and waste manifolds 12, 14.

The waste droplets mix with the gaseous oxidizer, in this embodiment air, from the air conduits 58 into a mixing zone around the inner lateral wall 72 of the primary combustion chamber 22. The mixing takes place in this mixing zone by the impingement of the waste with the plurality of airstreams from air conduits 58. The airstreams draw the waste to the air. The resulting impingement provides an additional atomization of the liquid waste. Atomization of the waste is desirable because the smaller the liquid waste droplets, the greater the exposure of the waste to the oxygen from the air and, therefore, greater oxidation. Large droplets do not gasify as readily.

In operation, the combustion air or oxidizing gas is passed from the air conduit 34 and into the air manifold 12 and is exposed to the divider plate 46 where heat is transferred to the combustion air. The pressure on the preheated combustion air forces the air into the upstream end of the air conduits 58 causing the preheated air to enter the primary combustion chamber 22 adjacent the inner lateral sides 72 of the primary combustion chamber 22. The air thus introduced forms a shroud of air around the outer periphery of the primary combustion chamber 22. The flow of the pressurized preheated combustion air through the air control conduits 58 occurs at a high velocity.

A hydrocarbon liquid waste is supplied to the waste manifold 14 by waste conduit 40 which is connected to the inlet of waste manifold 14 of the burner assembly 10. As previously indicated, a supply of fuel may be delivered to the waste supply until the combustion is self-supporting at around 2400° F. The waste flows through the waste manifold 14 where it is preheated by heat transfer from the air manifold 12 and by the heat conducted through the divider plate 46. The waste flows through waste conduit 52 and through the orifices 55 formed in nozzle 54. The nozzle causes an aspirating effect of the waste at the waste outlet 74.

The liquid waste is centrifuged outwardly and drawn to the air by the high velocity airstreams where it is entrained in the air near the inner lateral wall 72 of the combustion chamber 22. When the liquid waste reaches the outlet 74, the waste is subjected to high shear forces which break up the liquid into a fine fog-like mist. There is thereby provided additional means for atomizing the liquid waste. The centrifuging of liquid waste is enhanced by introducing the air tangentially creating a shroud of oxidizing air, thereby imparting to the waste, centrifugal motion prior to meeting the air at the mixing zone 76. Further, air conduits 58 may be disposed at an angle to the central axis of primary combustion chamber 22 as shown in FIG. 2 so as to impart a centrifugal force to the air.

The waste leaves outlet 74 in a fan-shaped pattern in a direction which intersects the shroud of air. The waste impinges upon the shroud of combustion air where it becomes mixed and entrained in the air. This entrainment causes turbulence of the air/waste mixture and a fan-shape pattern around the outer periphery of the primary combustion chamber 22 where it is ignited by the flame. The flow of the waste droplets is generally shown by the arrows at 78 and the shroud of air is shown generally by the arrow at 80. The point of the impingement of the waste and air shroud at the mixing zone is generally designated by the numeral 76. The mixing of the air/waste mixture is enhanced by the oxidizing gas which passes over the waste stream into the mixing zone. The oxidizing gas impinging on the waste stream causes mixing. Thus, there is provided a very thoroughly mixed set of reactant to insure a more complete combustion process.

The turbulent flow of the air/waste mixture through the primary combustion chamber 22 maximizes the efficiency of the burner assembly 10 and also maximizes the completeness of the combustion of the waste. The resulting product of the initial burn, much of which is carbon monoxide, at 76 impinges against annular shoulder 66. The inner radial annular ridge 68 folds the flame back onto itself and directs the resulting products of the initial burn towards the center of the primary combustion chamber 22 as is shown by the arrow at 82. This redirection of the resulting products of the initial burn causes turbulence which enhances the entrainment of the resulting product of the initial burn and the remaining oxygen from the air. The oxygen decreases rapidly during the initial combustion in the primary combustion chamber, but a residual quantity remains after the initial combustion. Since in this embodiment the oxidizer is air, the oxygen exceeds the needs for the initial combustion and is available for additional combustion.

The annular ridge 68 acts as a mixing throat between the primary and secondary combustion chambers to insure optimal combustion conditions. The throat acts as a return barrier for a part of the resulting products from the initial burn in the primary combustion chamber, thus insuring more uniform heat distribution within the primary combustion chamber.

The carbon monoxide product from the initial burn undergoes a second burn at 84 near the center of primary combustion chamber 22. The products resulting from the second burn at 84 then pass from primary combustion chamber 22 into secondary combustion chamber 24 as shown by arrow 86. The smaller secondary combustion chamber 24 pressurizes the product of the second burn to cause a third burn of any remaining waste. This pressurization continues to increase the concentration of the resulting products and air as they pass through the combustion system 20. This last stage burn occurs at 88 in secondary combustion chamber 24. All toxic products from the hydrocarbon waste will have been burned through the three-stage burn cycle in the combustion system 20 such that the flue gases exhausting at exit 70 are 99.99% free of contaminants in the airstream.

The burner has three different modes (1) oxidizing (excess air), (2) stoichometric (standard ratio), and (3) rich (excess fuel). The present system operates in the oxidizing or stoichiometric modes. To run the burner rich will prevent the complete combustion of waste in the combustion chamber and permit the exhaust of unburned waste products. The different modes will operate over the full firing range of the burner, and the firing range is only limited by the amount of pressure which can be placed on the combustion air and waste.

The oxidizer and waste mixture ratio depends upon the type of hydrocarbon waste and is controlled to reduce the emission of air pollutants. The oxidizer and waste mixture depends upon the BTUs and make-up of the waste. For example, one cubic foot of natural gas will require approximately two cubic feet of oxygen to produce 1023 to 1037 BTUs per cubic foot. Air is approximately 20% oxygen. For example, the air to natural gas ratio is approximately ten to one, and the air to propane ratio is approximately twenty-five to one.

The pressure of the air/waste mixture within primary combustion chamber 22 is preferably approximately 100 psi with the primary combustion chamber 22 having a temperature of approximately 3200° F. At this pressure and temperature, the constituents of the waste are broken down into minute parts. The burning of the air/waste mixture by the flame creates the flue gas. At this pressure and temperature, the flue gas velocities at the gas exhaust port 70 are in the range of 5000 feet per second. Mach 1 is approximately 2200 feet per second. As previously indicated, the air pressures can range from one psi to 500 psi. Once the air pressure passes approximately 25 psi, the velocity of the flue gases passes Mach 1 and will create a vacuum within the combustion system 20. At such velocities, the flue gas creates a back pressure against the flame. Generally after the air pressure reaches 10 psi, the flame will blow off if there is no back pressure in the combustion assembly 20.

The back pressure creates a vacuum in the primary combustion chamber 22. Although the vacuum due to the supersonic flow is not a substantial aid to the combustion process, it does contribute substantially to the turbulence and mixing of the gaseous oxidizer and waste. It is believed that this vacuum may substantially alter the rate of flame propagation of the waste to be burned. Thus, it is believed that the vacuum substantially assists in the combustion of the waste. The back pressure also levels out the heat within the combustion assembly 20 and prevents cold spots which are caused by a decrease in pressure due to a decrease in the volume of flue gas. The operation of the system with a back pressure also permits the reduction of the volume of the space required for the combustion assembly 20 and avoids much of the combustion space required by prior art burner systems. The combustion system 20 of the present invention uses the turbulence and mixing from the back pressure and vacuum caused by the high velocities to permit the burner assembly 10 to provide temperatures of up to 3600° F. in the combustion assembly 20 and the 100 psi air pressures to achieve flue gas velocities at exit 70 in excess of Mach 2.

With combustion air pressures in excess of 100 psi, and the creation of a back pressure, it is necessary to use an appropriate refractory for the combustion assembly 20. A refractory suitable for air pressures above 100 psi must be used since many refractories lose their adhesiveness when placed under vacuum. Such a combination of vacuum and high temperature requires that a refractory be used which has high temperature oxidation resistance, high abrasion and corrosion resistances, and good thermal shock resistance as described in U.S. Pat. Nos. 3,990,860; 3.926.567: 4,072.532; and 4,131 459. The refractory is originally in powder form and is pressed in a graphite mold in a vacuum furnace. Between the combination of pressure and heat, the refractory is sintered into a homogeneous piece. Thus, the burner block or refractory is modified in accordance with the operational parameters of the combustion assembly 20.

Should the waste combustion system be operated at air pressures less than 25 psi, less exotic refractories may be used for refractory lining 62. So long as the flue gas velocity does not pass Mach 1, a positive pressure is placed on the refractory of combustion assembly 20.

Figure 4:
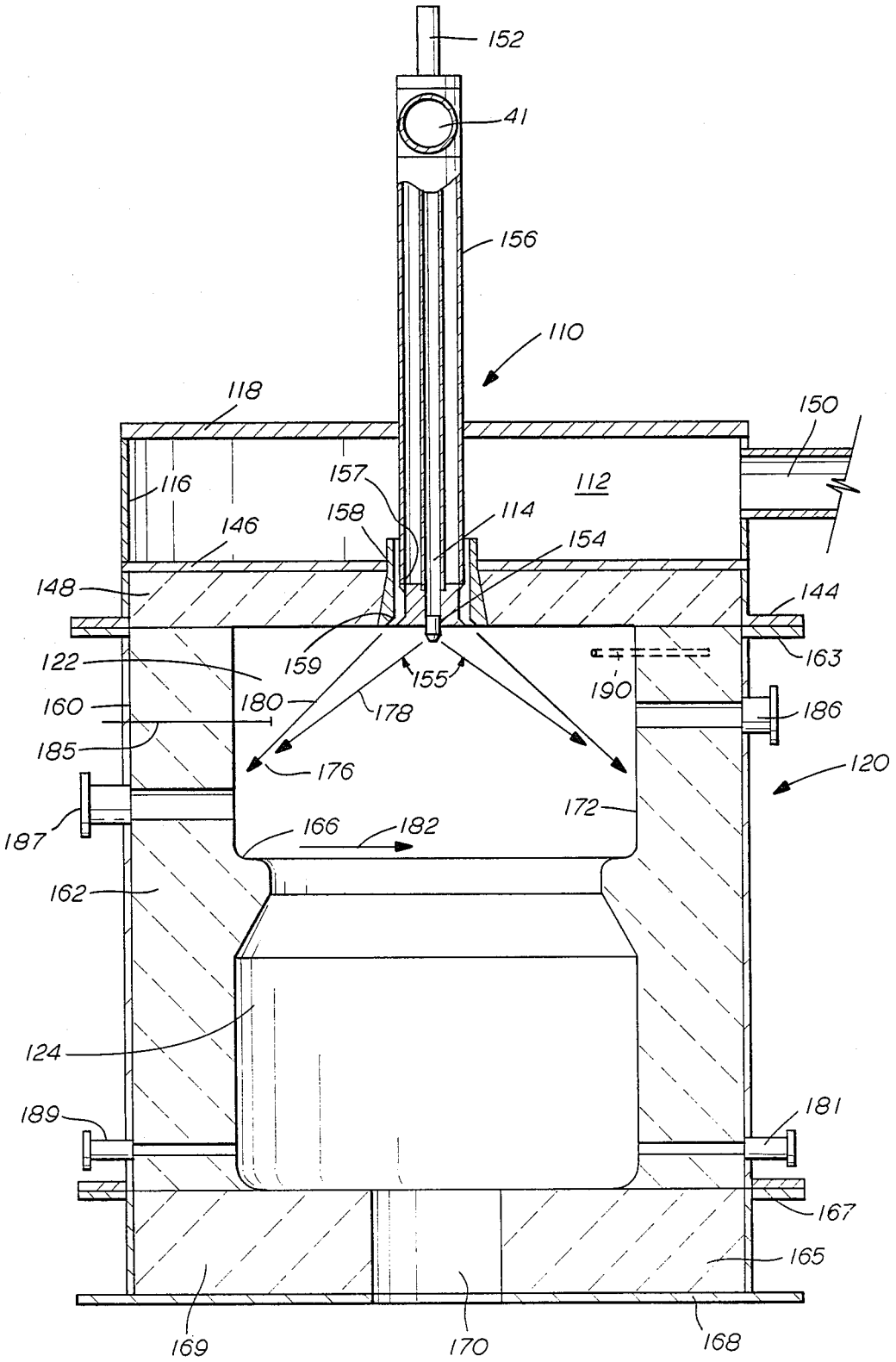
FIG. 4 is a sectional view of a preferred embodiment of the waste combustion system according to the invention.

Referring now to FIG. 4, the preferred waste combustion system of the present invention comprises a burner assembly 110 and a combustion assembly 120. The air/waste supply system may be similar to the air/-waste supply system 30 as shown in FIG. 3. The burner assembly 110 includes an air manifold or plenum 112 and a waste manifold 114. The supply system 30 pumps the waste to be disposed to the waste manifold 114 as well as supplying the gaseous oxidizer which is preferably air to the air manifold 112. The oxidizer may be air or enriched air or oxygen. In the embodiment of FIG. 1, the air was supplied under sufficient pressure that the velocity was in excess of Mach 1. However, depending upon the waste which is to be burned and oxidized, lower pressures such as air pressures between 1 and 50 psi may be suitable.

The burner assembly 110 has tubular sides 116 enclosed by a cover plate 118. Although the burner assembly is described and shown as being tubular, it can be readily appreciated that it may have various configurations. The configuration may be rectangular or square or spherical or any other of various shapes. The air manifold 112 is formed between the cover plate 118 and a divider plate 146. Attached to the divider plate 146 is a upper end of refractory 148. The air manifold 112 includes an inlet 150 for connection to the air supply conduit 34 as is schematically shown in FIG. 3. In this embodiment air inlet 150 is located off center or to one side of the air manifold 112. A mounting flange 144 and cover plate 118 are welded to the ends of the tubular side portion 116 to form the burner assembly 110.

The waste manifold 114 includes a tubular waste conduit 152 extending through the burner assembly 110 for communication with the combustion assembly 120. A nozzle 154 is provided at the terminal end of waste manifold 114. The nozzle 154 provides a spray of the waste material in fine droplets in a fan shape that may have an angle 155 which may vary from 30° to 120°. Such nozzles are manufactured by Delavan or other known manufacturers. The inlet end of waste manifold conduit 152 communicates with the waste supply conduit 40 shown in FIG. 3 for the supply of liquid waste to manifold 114. In this embodiment, it is preferred that the fuel line 41 not be connected to the waste supply conduit 40 as shown in FIG. 3, but be directly introduced to a concentric conduit 156 which surrounds the tubular waste conduit 152.

In this embodiment, the air and waste manifolds may be made of the material similarly as in the embodiment of FIG. 1. Likewise, the gaseous oxidizer which is preferably combustion air is preheated by the arrangement of the air manifold 112 above the divider plate 146 to increase the efficiency of the burner assembly 110.

In this embodiment, the preheated combustion air in air manifold 112 is supplied to the combustion assembly 120 through a centrally located tubular venturi member 158. Venturi member 158 is attached to the divider plate 146 and extends upwardly above the plate a small distance. Refractory 148 surrounds the other end of the venturi member 158. The venturi member 158 is concentric to the outer end of the conduit 156, which is machined to a smooth surface, and is sized to form passages between member 158 and conduit 156. The reduction in cross section between the plenum 112 and the primary combustion chamber 122 provides a venturi affect of the air passing through the passages of venturi member 158. As the air passes through the venturi member 158, fuel, preferably natural gas, is introduced into the air stream through openings or ports 157 near the end of conduit 156 communicating between the passages and flow bore of conduit 156. The air and fuel are mixed at the backside of the nozzle 154 which has a deflector surface 159 wherein the air and fuel are introduced into the combustion assembly 120. The internal diameter of the venturi member 158 sizes the passages so as deliver the calculated amount of air and fuel at the desired velocities. The sizing of a venturi to obtain the desired amount or velocities for the combustion air and fuel is well known to those skilled in the art.

The combustion assembly 120 includes an outer metal jacket or shell 160 with a lining of refractory 162 which is molded to form primary combustion chamber 122 and a downstream secondary combustion chamber 124. A fibre insulation may be provided between the metal shell 160 and the refractory lining 162 if desired. A flange 163 is welded to the upper end of outer shell 160 for the mounting of the burner assembly 120 by bolting mounting flange 144 to flange 163. A closure section 165 is affixed to the downstream terminal end of shell 160. The closure section 165 includes a mounting flange on shell 160 for bolting to flange 167 of the closure section 165. The combustion assembly 120 may be terminated with a closure plate 168.

The primary combustion chamber 122 is circular in cross-section and co-axial with the waste conduit 152 and the nozzle 154. The secondary combustion chamber 124 is located downstream of the primary combustion chamber 122 and is co-axial therewith. Secondary combustion chamber 124 is illustrated as circular in cross-section and having a diameter substantially the same as that of primary combustion chamber 122. Between the primary combustion chamber 122 and the secondary combustion chamber 124 is an annular shoulder 166 which defines the end of one combustion chamber and the beginning of the second. Furthermore, the shoulder 166 is shown as continuous. Shoulder 166 may also be discontinuous, that is only around a portion of the peripheral wall of the primary combustion chamber 122. The smaller cross-section of combustion assembly 120 formed by shoulder 166 causes turbulent flow rather than laminar flow in the combustion assembly 120 and provides the mixing of the waste and gaseous oxidizer necessary for good combustion within the primary combustion chamber 122.

A flue gas exhaust port 170 is provided at the downstream end of secondary combustion chamber 124 for the vending of the flue gases resulting from the combustion of the waste. Port 170 extends through refractory lining 169 and may have an enlarged diameter aperture (not shown) in closure plate 168. Port 170 is co-axial with the primary and secondary combustion chambers. The diameter of the flue gas port 170 is such that the waste which is burned in the primary and secondary combustion chambers is fully burned within the combustion assembly 120 with only the flue gas passing through the exit port 170. The diameter of port 170 is sized in relationship to the total volume of the combustion chambers and the amount of material that is being introduced into the combustion assembly 120.

In this embodiment, the primary combustion chamber 122 is defined by the end wall formed by the refractory 148, and a lateral chamber wall 172 which extends to the shoulder 166. The waste and combustion air are introduced into the primary combustion chamber 122 where they are intimately mixed in a mixing zone 176 adjacent the inner lateral wall 172 of the primary combustion chamber 122. The mixing takes place in this mixing zone 176, in that the waste leaves nozzle 154 in a fan shaped spray as depicted by line 178. The air on the other hand is deflected by the deflection plate 159 at the backside of the nozzle 154 and has a general line of movement along the line 180. Although these are shown as lines 178 and 180, there is a low pressure point between the two lines in which the air stream which is at a greater velocity draws the waste towards the air so as to be mixed in the mixing zone 176. This mixing zone is adjacent the lateral wall 172 and above the shoulder 166. The first substantial combustion of the waste occurs at this mixing zone 176. The products of the first combustion are deflected inwardly by shoulder 166 as depicted by line 182 where the products of combustion are combined with further oxygen in the air for further combustion. For the complete combustion of the waste, it is desired to atomize the waste as much as possible as well as to provide substantial mixing of the waste in the combustion air.

The combustion assembly 120 also includes an ignition system 185 to ignite the air/fuel mixture. Flame scanner ports 186, 187, 188 and 189 provide ports for visually determining the flame propagation. Also scanner ports may be used to insert temperature themocouples or other devices for measuring temperature or controller devices.

To further provide turbulence within the primary combustion chamber 122, a portion of the air being introduced through inlet 150, may be introduced into line 190 which will pass the air tangentially toward the chamber wall 172 of combustion chamber 122. Alternately, rather than introducing a portion of the combustion air through line 190 to enhance the oxidation and combustion of the waste in the combustion chamber 122. As much as 15 to 20% of the airmay be introduced into the combustion chamber 122 through line 190. When oxygen is used, it is introduced by line 190.

The waste combustion system of the present invention is sized to provide mobile incineration. Mobile treatment of waste is advantageous in that mobile units are able to travel from one waste site to another. For example, the waste combustion system of the present invention can be mounted on a flatbed trailer to become a mobile incinerator. Such portable units can ease the treatment capacity crunch and minimize the risks now involved in the transportation of hazardous waste.

The waste combustion system of the present invention is intended to provide a system wherein the complete combustion of the waste is carried out in the combustion assembly 120. The gases exiting the exhaust port 170 are products of complete combustion. However, it is contemplated that the combustion assembly 120 with its neck down portion formed by closure section 165 and the exit port 170, may be attached to a further refractory lined structure (not shown), having a structure similar to the combustion chambers 124. This further refractory lined structure is to provide further retention time of the waste gases in a confined structure and assure complete combustion and some cooling before being recovered from the combustion system.

Figure 5:
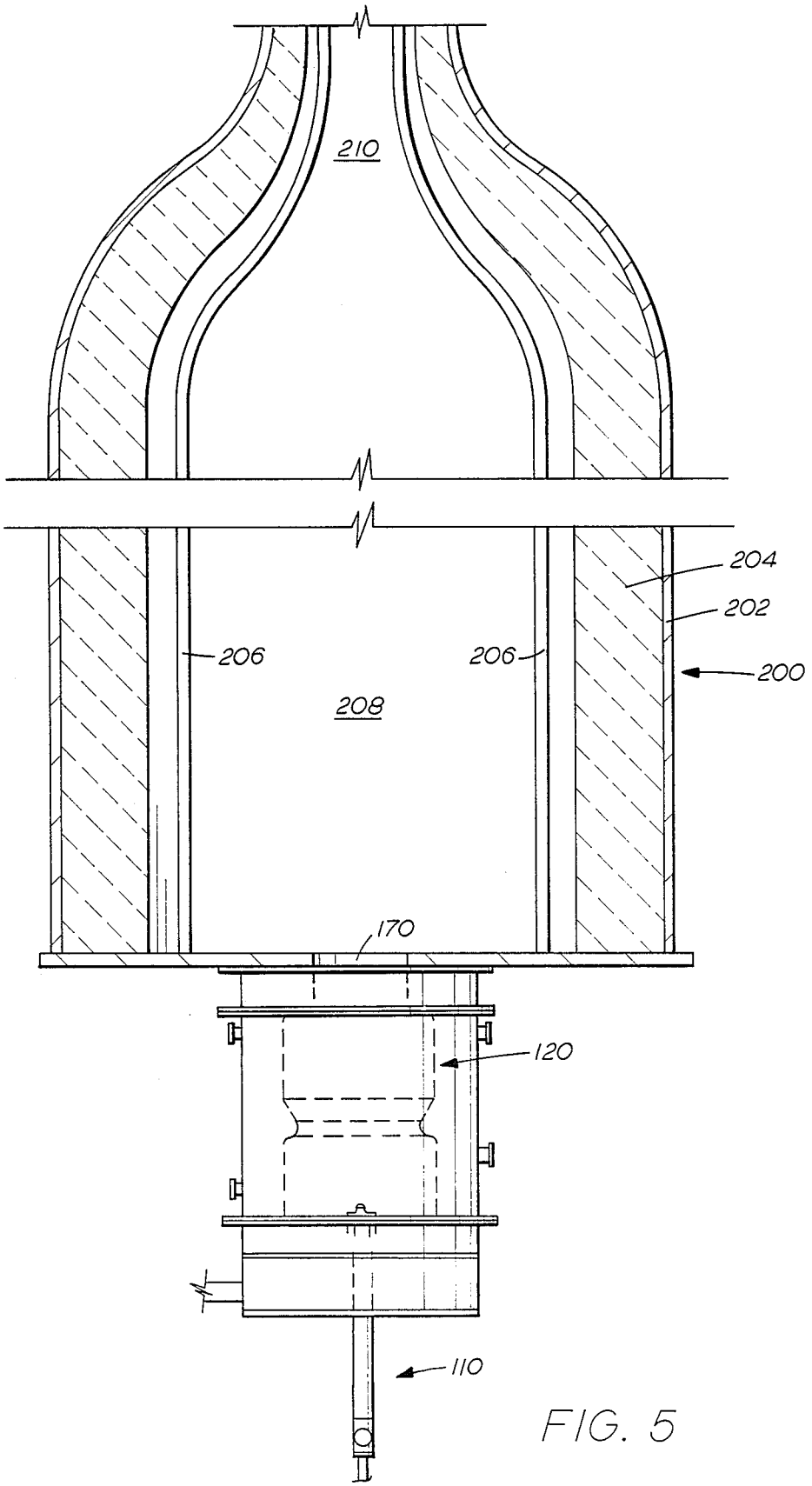
FIG. 5 is a sectional view of the combustion system shown in FIG. 4 and a heat exchanger for recovering the heat formed in the system.

Referring now to FIG. 5, alternatively the combustion assembly 120 can be connected to a heat exchanger 200. The heat exchanger may have an outer metal wall 202 with a lining of refractory or insulation 204 to provide a shell. A plurality of tubes 206 are disposed within heat exchanger 200. The lower ends of the tubes 206 or the portion of the tubes near the exhaust port 170 are heated by convection and radiation. The specific configuration of tubes 206 will take into account the specific service for the processing and disposal of particular waste, the amount of waste being burned, the fluid that is being heated within the tubes 206, and the sizing and number of tubes to be employed within the exchanger 200. The heat exchanger will have a plenum chamber 208, which is that portion not having any tubes adjacent to the exit port 170 of the combustion system. The upper portion of the heat exchanger 200 has a convection zone 210 where the tubes will come closer together as the flue gases have given up considerable amount of the heat before exiting the heat exchanger 200. It is noted that the sizing of the exit port 170 is adjusted when utilizing a heat exchanger 200 in conjunction with the combustion assembly 120. With the heat exchanger 200 disposed on the end of combustion assembly 120, plenum space 208 of the heat exchanger provides further time and space for additional combustion of the waste if necessary. It is preferred, however, that the combustion take place within the combustion assembly 120 and that only the hot gases exit through exit port 170 into the heat exchanger 200. Specifically, the heat exchanger 200 may be heating water to produce steam. The steam produced may be introduced by line 190 into the primary combustion chamber 122 when steam is advantageously used in the combustion of certain waste. With the introduction of oxygen and/or steam, as well as fuel, in addition to the air, primary combustion chamber 122 is a reactor for the waste to assure the complete combustion thereof.

Changes and modifications may be made in the specific illustrated embodiments of the invention shown and/or described herein without departing from the scope of the invention as defined in the appended claims.

We claim:

1. A combustion system for burning fluid waste with a fuel and gaseous oxidizer, comprising:

an annular combustion assembly having a primary combustion chamber with an outer peripheral wall and a coaxial secondary combustion chamber;

a burner assembly mounted coaxially on the end of said primary combustion chamber opposite said secondary combustion chamber, said burner assembly having a gaseous oxidizer manifold mounted in said end, a venturi member extending through said end between said manifold and said primary combustion chamber, a waste conduit communicating with a nozzle disposed on said venturi member for atomizing the waste in said primary combustion chamber, and a fuel conduit communicating with ports in said venturi member for mixing the fuel with the gaseous oxidizer;

said venturi having apertures therethrough for the passage of the gaseous oxidizer from said manifold into said primary combustion chamber, said ports communicating with said apertures whereby the fuel is introduced into the stream of gaseous oxidizer passing through said apertures;

said venturi member further including a deflector surface to direct the mixture of fuel and gaseous oxidizer toward said outer peripheral wall for mixing and combustion with the atomized waste form said nozzle;

an annular shoulder formed between said primary and secondary combustion chambers and facing said burner assembly; and said burner assembly directing the flow of the waste and gaseous oxidizer into said primary combustion chamber whereby the fuel and gaseous oxidizer mixture and atomized waste mix within the primary combustion chamber adjacent said outer peripheral wall and before said shoulder for combustion.

2. The combustion system of claim 1 wherein said shoulder directs the resulting product of the first burn toward the center of said primary combustion chamber.

3. A combustion system for burning fluid waste with a fuel and gaseous oxidizer, comprising:

a generally cylindrical primary combustion chamber having an outer peripheral wall;

a burner mounted coaxially on one end of said primary combustion chamber and having a gaseous oxidizer manifold mounted on said one end, a venturi member extending through said one end between said manifold and said primary combustion chamber, a waste conduit communicating with a nozzle in said venturi member for atomizing the waste in said primary combustion chamber, and a fuel conduit communicating with ports in said venturi member for mixing the fuel with the gaseous oxidizer;

said venturi having apertures therethrough for the passage of the gaseous oxidizer from said manifold into said primary combustion chamber, said ports communicating with said apertures whereby the fuel is introduced into the stream of gaseous oxidizer passing through said apertures;

a second combustion chamber disposed other end of said primary combustion chamber and forming a shoulder facing said burner;

said burner having oxidizer supply means and waste supply means for supplying a gaseous oxidizer and waste to said waste conduit and manifold;

said burner directing the flow of the waste and fuel-gaseous oxidizer mixture into said primary combustion chamber whereby the gaseous oxidizer, fuel and waste mix within the primary combustion chamber adjacent said outer peripheral wall and said shoulder for a first burn; and said shoulder directing the resulting product of the first burn toward the center of said primary combustion chamber for a second burn.

4. The combustion system of claim 3 wherein said nozzle directs the waste toward said shoulder.

5. The combustion system of claim 3 wherein said primary and secondary combustion chambers are lined with refractory resistant to thermal shock.

6. The combustion system of claim 3 which further includes:

ignition means for providing a flame to ignite the gaseous oxidizer, fuel and waste mixture adjacent said shoulder.

7. The combustion system of claim 4 wherein the oxidizer supply means is coaxial and surrounds said waste supply means.

8. The combustion system of claim 7 wherein said venturi member has a deflector surface for directing the gaseous oxidizer and fuel mixture outwardly from said venturi member in a stream adjacent said outer wall of said primary combustion chamber.

9. A combustion system for burning fluid waste with a fuel and gaseous oxidizer comprising:

a generally cylindrical primary combustion chamber having an outer peripheral wall;

a burner assembly mounted on one end of said primary combustion chamber and having a gaseous oxidizer manifold mounted on said end, a venturi member extending through said end between said manifold and said primary combustion chamber, a waste conduit communicating with a nozzle in said venturi member for atomizing the waste in said primary combustion chamber, and a fuel conduit communicating with ports in said venturi member for mixing the fuel with the gaseous oxidizer;

said venturi having apertures therethrough for the passage of the gaseous oxidizer from said manifold into said primary combustion chamber, said ports communicating with said apertures whereby the fuel is introduced into the stream of gaseous oxidizer passing through said apertures;

said venturi member coaxially of said waste and fuel conduits for supplying the gaseous oxidizer to said primary combustion chamber; said venturi member having a deflector surface for directing the gaseous oxidizer and fuel mixture outwardly from said venturi member in a stream adjacent said outer wall of said primary combustion chamber;

said nozzle directing said waste in a hollow cone shaped pattern so as to intersect said outwardly directed stream of mixed gaseous oxidizer and fuel;

said intersection causing the waste to mix and become entrained with the mixed gaseous oxidizer and fuel thereby forming a waste/gaseous oxidizer/fuel mixture for combustion;

a secondary combustion chamber disposed on the other end of said primary combustion chamber and forming a shoulder facing said nozzle; and said shoulder directing the resulting product of the waste/gaseous oxidizer/fuel mixture toward the center of said primary combustion chamber for a second burn.

10. The combustion system of claim 9 wherein said secondary combustion chamber includes an exhaust port for the exiting of flue gases resulting from the combustion and the system further including a heat exchanger mounted on said other end of said secondary combustion chamber for receiving said exiting flue gases.

11. The combination of claim 10 wherein a plurality of tubes are disposed within said heat exchanger.

12. The combination of claim 10 wherein said primary combustion chamber is a reactor for combustion of said waste.

13. A combustion system for burning fluid waste with a fuel and gaseous oxidizer, comprising:

a combustion assembly having first and second end walls with a lateral wall forming a combustion chamber;

a burner assembly having a gaseous oxidizer manifold mounted on said first end wall, a venturi member extending through said first end wall between said manifold and said combustion chamber, a waste conduit communicating with a nozzle in said venturi member for atomizing the waste in said combustion chamber, and a fuel conduit communicating with ports in said venturi member for mixing the fuel with the gaseous oxidizer;

said venturi having apertures therethrough for the passage of the gaseous oxidizer from said manifold into said combustion chamber, said ports communicating with said apertures whereby the fuel is introduced into the stream of gaseous oxidizer passing through said apertures;

said venturi member further including a deflector surface to direct the mixture of fuel and gaseous oxidizer toward said lateral wall for mixing and combustion with the atomized waste from said nozzle;

said lateral wall including a shoulder for causing turbulent flow of the product of said combustion; and said second end having an exhaust port for flue gases resulting from said burning of the waste.

14. The combustion system of claim 13 further including a supply port extending through said lateral wall for supplying a secondary gaseous oxidizer to said combustion chamber.

15. The combustion system of claim 14 wherein said secondary gaseous oxidizer is introduced within said combustion chamber at an angle.

16. The combustion system of claim 14 wherein said secondary gaseous oxidizer is oxygen.

17. The combustion system of claim 14 wherein said secondary gaseous oxidizer is steam.

18. The combustion system of claim 17 wherein said steam is formed using the heat from the exiting flue gases.

* * * * *